United States Patent [19]

Roberts

[11] 4,062,072

[45] Dec. 13, 1977

[54] PORTABLE BIDETS

[76] Inventor: Arthur Bruce Roberts, 37 Culver Road N. W., Calgary, Alberta, Canada

[21] Appl. No.: 710,879

[22] Filed: Aug. 2, 1976

[30] Foreign Application Priority Data

Dec. 11, 1975 Canada ..... 241564

[51] Int. Cl.[2] ..... A47K 11/08; A47K 3/22

[52] U.S. Cl. ..... 4/7; 4/6

[58] Field of Search ..... 4/7, 6, 1, 249

[56] References Cited

U.S. PATENT DOCUMENTS

| | | | |
|---|---|---|---|
| 1,866,930 | 7/1932 | Guidetti et al. | 4/7 |
| 2,104,271 | 1/1938 | Parisini | 4/7 |
| 2,605,477 | 8/1952 | Monserrat | 4/7 |
| 2,762,058 | 9/1956 | Hurko | 4/7 |
| 2,774,078 | 12/1956 | Pazos | 4/7 |
| 2,852,782 | 9/1958 | Sundberg | 4/7 |
| 3,045,248 | 7/1962 | Gentry | 4/7 |
| 3,513,487 | 5/1970 | Palermo et al. | 4/7 |
| 3,570,015 | 3/1971 | Rosengaus | 4/7 |
| 3,605,124 | 9/1971 | Marcard et al. | 4/7 |
| 3,781,919 | 1/1974 | Ayala | 4/7 |

*Primary Examiner*—Henry K. Artis
*Attorney, Agent, or Firm*—Shlesinger, Arkwright, Garvey & Dinsmore

[57] ABSTRACT

A portable bidet which comprises an adaptor to facilitate the interconnection of the bidet with a source of water under pressure; a water discharge tube and nozzle mounted for movement from an inoperative position substantially beneath the internal rim of a toilet bowl to a predetermined operative position wherein the nozzle lies substantially centrally of the bowl; a valve for variably controlling the flow of water to the discharge tube and nozzle, and; a manually operable level pivotally mounted adjacent the bowl but externally thereof, whereby initial movement of the lever affects movement of the discharge tube and nozzle to the operative position, and continued movement of the lever in the same direction affects gradual opening of the valve means without causing further displacement of the discharge tube and nozzle from the operating position. In the preferred embodiments this adaptor provides for the reception of hot and cold water streams, and the mixing thereof to a predetermined operating temperature. The invention further provides for fluid other than water, to be introduced into the water discharged through the nozzle, this fluid being for example, a soap solution, deoderant, or a medicinal preparation. Additionally, the incorporation of a drying facility operable independently of said bidet and subsequent to the use thereof, is invisaged.

19 Claims, 8 Drawing Figures

PORTABLE BIDETS

The invention relates to bidets and more particularly to a portable bidet attachment, that may be utilized in conjunction with any conventional toilet facility.

Bidets per se have been in use for a number of years, and numerous patents have been granted on improvements to the original concept. Indeed many types of bidet are currently being manufactured.

In its most general form, the bidet is provided as a complete bathroom fixture, requiring its own plumbing. This type of device has however failed to achieve popularity, since in the average household bathroom, there is a lack of available space. In addition, the high retail and installation costs have tended to reduce the attractability of such a facility.

The cost factor has also contributed considerably to the lack of use of this particular device, by, for example, hospitals, and nursing homes, where the personal hygiene of certain patients, presents a daily problem.

In order to combat the problem of space in the conventional bathroom, a bidet, the subject of Canadian Patent Ser. No. 870,305 issued to Wintercorn et al. on May 11, 1971, was devised. This particular bidet was designed to be swingable outwardly from a wall cabinet, and back into it, so as to be out of the way, as well as out of sight when not in use. This device could therefore be installed in relatively small bathrooms where a separate bidet bowl of the conventional fixed type would not be used. This particular invention further involved utilization of hot and cold water for more efficient cleansing. As must be appreciated, the device was not portable and installation costs involved would be exceptionally high.

In Canadian Patent Ser. No. 638,751, which issued Mar. 27th, 1962 to H. M. Umann, an attempt was made to overcome the aforementioned problems by incorporating a bidet attachment to the conventional toilet seat. This highly complex device utilized a number of fixed, inwardly directed water sprays, positioned within the hollow seat around the central seat opening. Heaters were provided within the seat to regulate the temperature of the water, and in addition a pair of electric motor were also incorporated driving an air blower, which delivered warm air to the exposed areas of the body to facilitate drying. Apart from the cost factor, which would be considerably high, this particular device suffers two serious drawbacks. The first being the susceptability to damage. Toilet seats are always being dropped, which in this case could not only result in damage to the numerous components within the seat, but the very weight of the seat, if brought down heavily on the toilet bowl could cause extensive damage. The second disadvantage, is that this particular device embodies many components actuated by electricity. Since the device is being used in close proximity to water, the problem of corrosion must be faced which could ultimately cause electrical shorting, possible fire, and even electrocution of the user.

A more portable type of apparatus is invisaged by U.S. Pat. No. 3,602,921, issued to H. M. Umann on Sept. 7th, 1971. This particular attachment for toilets includes a hand operated pump which is removably attached to the side of a toilet bowl and a bidet nozzle which is removably attached to the rear side of the toilet seat. The pump and nozzle are connected by a hose, and the pump is arranged to receive a removable, collapsable bag which retains the supply of water. Water pressure cannot however be maintained, since the device relies on manual actuation of the pump. This invention, while able to dispense an aqueous cleansing solution (soap) or medicinal solution, could not dispense rinse water ro remove for example the soap without refilling the specified container with water.

Finally, U.S. Pat. No. 3,605,124, issued Sept. 20, 1971 to Henry G. Marcard and Carlos A. Vincenzi, discloses a portable bidet adapted for attachment to a conventional toilet. This particular apparatus has a fluid delivery pipe rotatably connected to a pivot valve such that it may rotate from its inactive position adjacent the internal rim of the toilet bowl to an operating position in the center of the bowl. A heat and thermostatic valve are provided to heat the water, and a dump valve is used to assist in the automatic cleaning of the toilet bowl. This particular device has a number of disadvantages which could render it impracticable. Firstly, only stationary water within the heated region would be at a control temperature, water in the pipe moving through the controlled heating area would not have sufficient time to be heated and would be sprayed at its original temperature. A heat exchanger of considerable proportion would be required in order to maintain constant temperature control. The description further indicated that if the water became over-heated due to a malfunction of the thermostatic control of the water heater, then the very hot water would be diverted into the bowl by a bi-metallic valve which is located upstream of the spray nozzle. However, it can be seen from the diagrams that a good portion of this hot water would pass through the valve before it had a chance to close and divert the remaining hot water. The user of this device would therefore start his day not knowing whether he was to be frozen, scalded, or possibly electrocuted, should the heater malfunction. In addition, the device according to this patent will not operate as an effective bidet at low or variable water pressures, since the mechanism will position the spray nozzle in the center of the toilet bowl only if the control valve is moved to a position of three-fourths to full open immediately. If the valve is opened slowly, the nozzle will not reach the center of the toilet bowl due to opposing spring action, and will therefore spray off center. There is also the possibility, that the water will start to spray before the nozzle reaches the center of the toilet bowl and also continue spraying after the nozzle starts to return to its off position.

Accordingly, the invention seeks to overcome the aforementioned advantages by providing a portable bidet which comprises an adaptor facilitating the interconnection of the bidet with a source of water under pressure; a water discharge tube and nozzle mounted to permit movement from an inoperative position substantially beneath the internal rim of the toilet bowl to a predetermined operative position wherein the nozzle lies substantially centrally of the bowl; a valve for variably controlling the flow of water to the discharge tube and nozzle and manually operable lever pivotally mounted adjacent the bowl but externally thereof whereby initial movement of the lever affects movement of the discharge tube and nozzle to the operative position. Continued movement of the lever in the same direction causes gradual opening of the valve without causing further displacement of the discharge tube and nozzle from the operating position.

In its preferable form the adaptor is formed to accept hot and cold water streams and to mix these streams to a predetermined operating temperature.

The discharge tube and nozzle is displaced by contact between a first projecting portion of the lever and an actuator mounted on a shaft, the end of the shaft remote from the actuator carrying a member adapted to engage a discharge tube and cause movement thereof about a flexible portion of the tube adjacent the member. The actuator may be formed with a cam-like profile which permits movement of the discharge tube and nozzle only to the desired operating position, or, as a pinion engageable with a rack carried by the first projecting portion of the lever. The rack should be dimensioned sufficiently to allow movement of the discharge tube and nozzle only to the desired operating positions. The operating lever in the preferred embodiment is provided with a second projecting portion spaced from the first projecting portion longitudinally of the lever towards the distal end thereof, and the actuation of the water valve supplying water to the discharge tube and nozzle is a result of contact between the valve and this second projecting portion.

The invention further provides that fluid other than water may be introduced into the water being discharged through the nozzle, this fluid being for example a soap solution or a medical preparation. A suitable compartmented container is provided, releasably attached to the bidet mechanism, for retention of these additional fluids, which may be extracted and intermixed with the main flow of water passing through the bidet by a siphoning system used in conjunction with a venturi tube.

Finally, the invention further contemplates the provision of a drying facility in the form of a hot air blower and hot air discharge nozzle which may be positioned at the rear of the toilet bowl in-between the bowl and the seat.

These other features of the present invention will clearly be understood from the following description of a preferred embodiment thereof, given by way of example with reference to the accompanying drawings in which:

FIG. 1 is a perspective view of one type of fitting, as may be used to facilitate the use of the device according to the present invention in a conventional bathroom.

FIG. 1*a* shows a perspective view of an alternative device for attaching the invention to a faucet.

Figure 1:
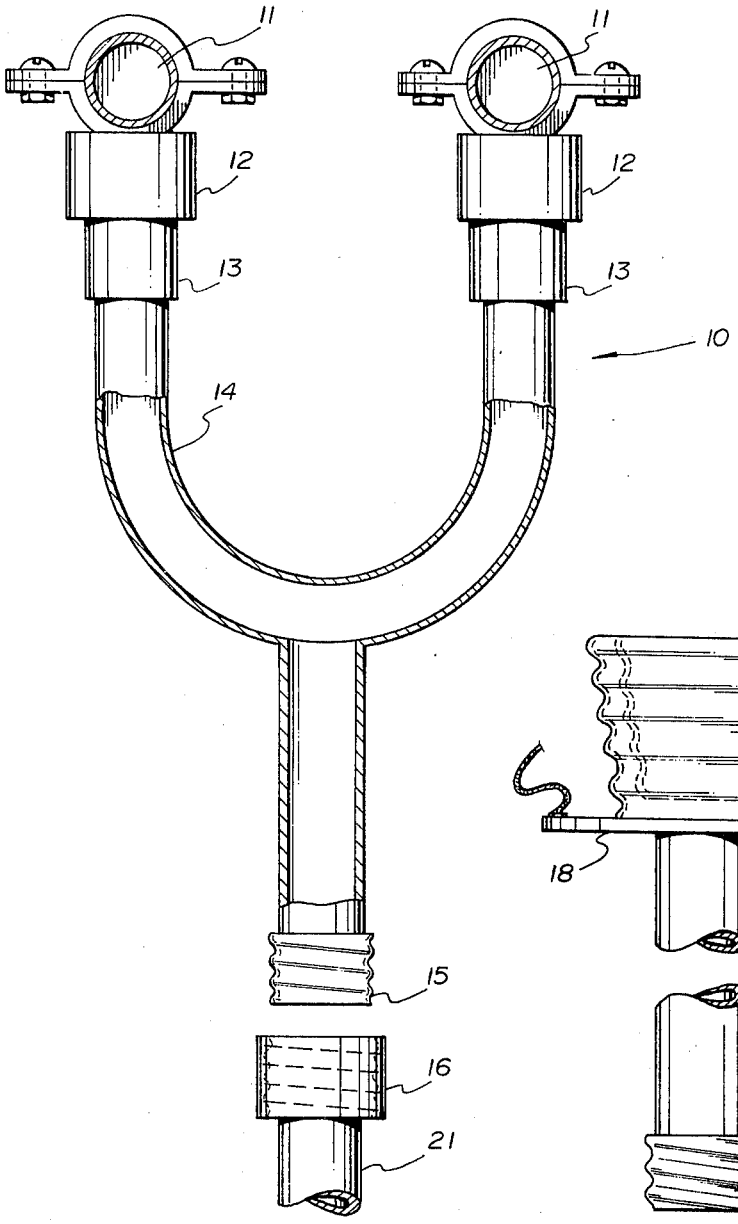
Figure 1A:
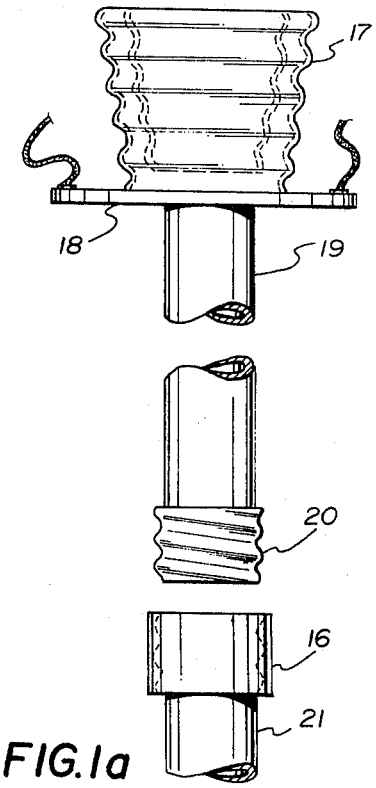

Referring now to the drawings, FIG. 1 and 1*a* disclose two alternative methods of connecting the bidet to a source of hot and cold water.

It must however be appreciated that numerous methods of connection are available and the two following examples must not be construed as in any way limiting. In the connection according to FIG. 1, which will be used in, for example, a bathroom fixture, we have an adaptor generally indicated at 10, which draws hot and cold water from the main supply through water pipes 11. Connection can be affected by drilling a hole into both pipes, however should the pipe diameter be too small, the pipes will have to be cut and a "tee" with an opening installed. The water will then pass through pressure valves 12, spring-loaded check valve 13 to outlet 15 via yoke 14. Outlet 15 being provided with a male screw coupling for interconnection with the female coupling15 of the bidet attachment.

A simpler, and less permanent attachment is invisaged by FIG. 1*a* where a slip and clamp-on rubber device 17 is placed over, for example a wash basin, or bath tub water faucet. This may be held in place by means of a clamping bar 18 with cords 19 to secure same to the faucet. Mixed hot and cold water at the desired temperature will then pass through flexible hose 19 to the male coupling 20. Interconnection with the bidet attachment can be affected as before utilizing female coupling 16.

Figure 2:
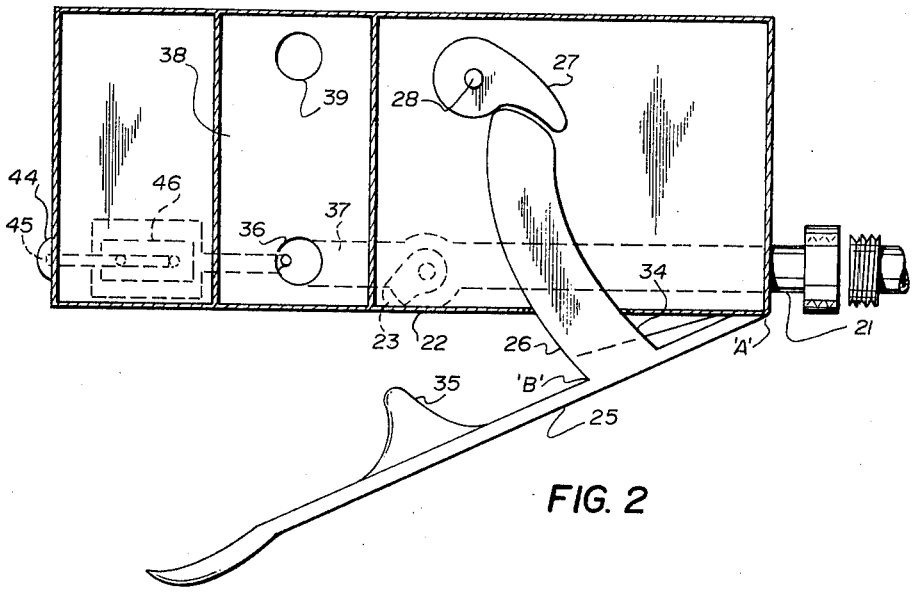
FIG. 2 is a plan view of the bidet mechanism as fastened to a toilet bowl rim, showing the lever action and how it relates to the positioning of the discharge nozzle and modulation of water supply to the discharge nozzle.
Figure 4:
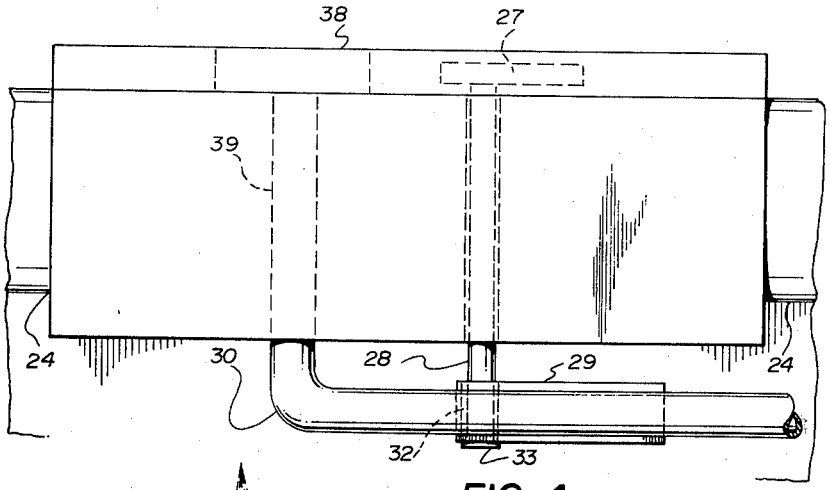
FIG. 4 (sheet 2) is a side view of the bidet mechanism as seen from the interior of the toilet bowl, and shows the discharge tube and nozzle, as well as the mechanism uuilized to position the nozzle within the toilet bowl when in use.
Figure 6:
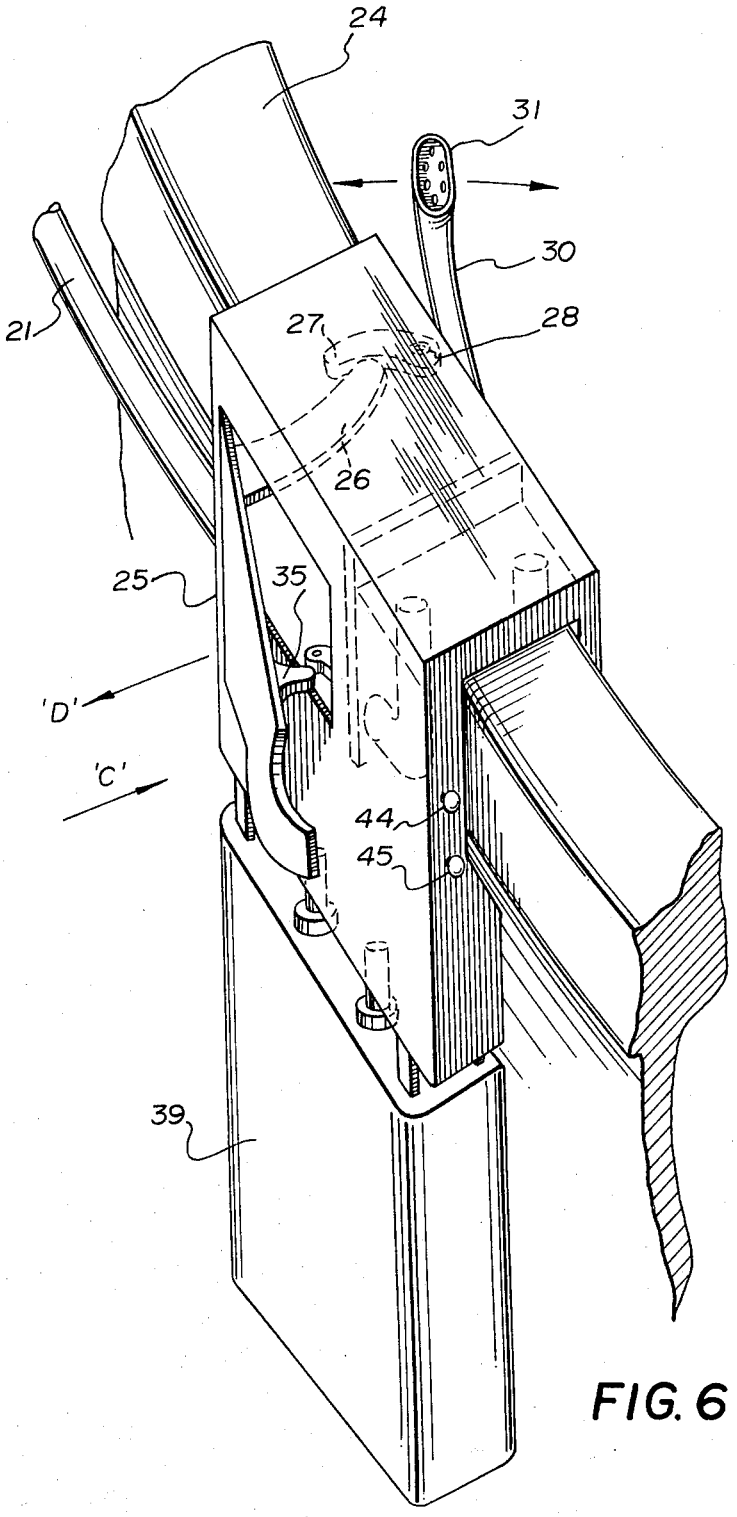
FIG. 6 is a perspective view of the entire bidet attached to a toilet bowl rim.

Water from either attachment, passes through bidet connecting hose 21, to a spring-loaded (fail-shut) ball type valve 22 which is provided with a cam-shaped control actuator 23 embodied within the bidet mechanism (see FIG. 2). The entire mechanism is clamped to the rim of the toilet bowl, 24 (FIGS. 4 and 6).

Water under pressure is now at the upstream side of the water control valve 22, which by virtue of the spring-loaded actuater 23 remains in closed position when not in use. By manual depression of control lever 25 towards the toilet bowl, the control lever, which is preferably formed as integral component of the bidet body will pivot at "A" of FIG. 2, causing the lever arm 26 to move against actuating cam 27 and rotate the control rod 28 (FIGS. 2 and 4), causing the control arm 29 (FIG. 4) to bend, the spray hose 30 and swing discharge nozzle 39 (FIG. 5), to the desired position within the toilet bowl. The control arm 29 is connected to control rod 28 (FIG. 4) by a splined end 32 and locking screw 33, in order to allow for adjustment in the positioning of the discharge nozzle 31 within different sized toilet bowls.

As will be appreciated, a rack and pinion assembly could be utilized to control the rotation and positioning of the discharge hose and nozzle. In such an arrangement cam 27 would be replaced by a suitable sized pinion, and an engaging rack, formed on or attached to projection or lever arm 26.

In use, control lever 25 is depressed towards the toilet bowl under shoulder 34 of arm 26 abuts the bidet body, at which time the discharge nozzle 31 is centrally disposed in its operating position. Further depression of the control lever 25 causes the lever to bend essentially at "B" in FIG. 2, at which time projection 35 on control lever 25 will contact actuator 23 causing same to rotate.

Figure 3:
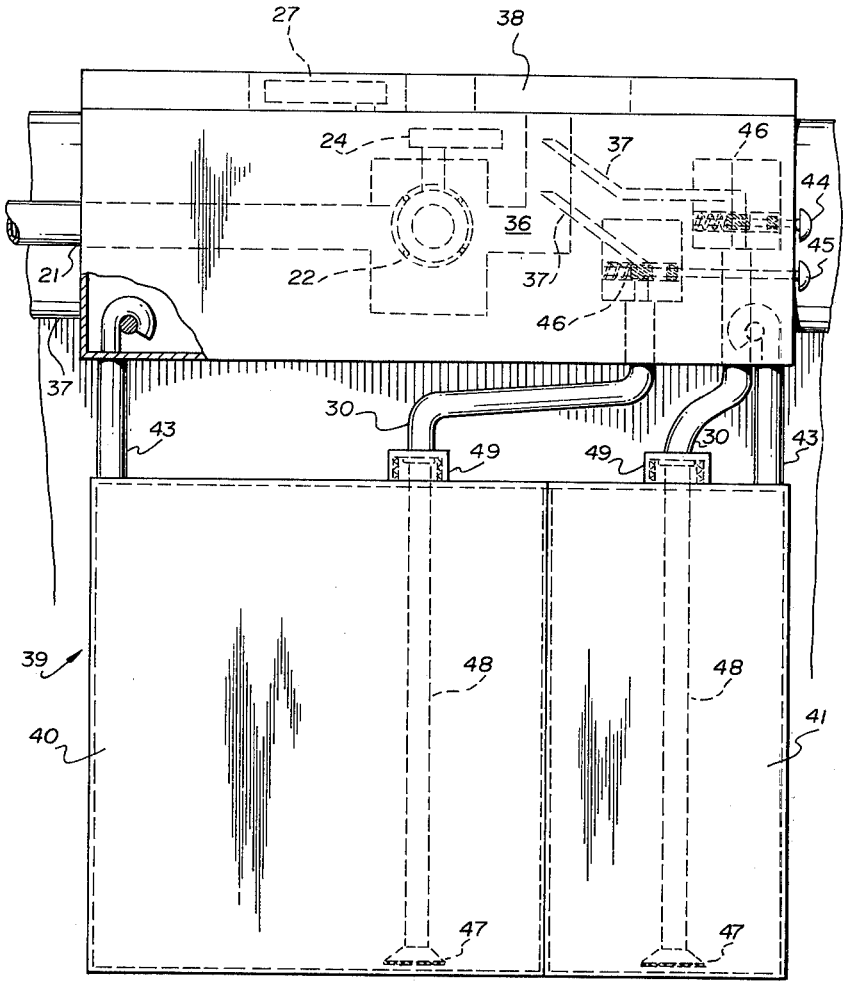
FIG. 3 (on sheet 3) is a side view of the bidet mechanism from the exterior of the toilet bowl, and shows the water control valve and water course, in addition to the valves, venturi spouts, and control buttons which govern the dispensing of soap and medication from the separable container which depends from the base of the bidet mechanism. The actuating lever has been omitted for sake of clarity.

Minimum depression of control lever 25 from this position, will cause minimum rotation of actuator 23 and therefore a minimum flow through the ball control valve 22 (FIG. 2 and 3). Conversely, a maximum depression of the control lever 25 will cause full opening of control valve 22 and therefore a maximum flow of water to the discharge nozzle. Thus, nozzle pressure is determined by the amount of control lever depression, or bending, after shoulder 34 has come to rest against the bidet body.

Upon opening the control valve the desired amount, water will travel through passage 36 (FIG. 3) from the control valve 22, pass the venturi tubes 37, the purpose of which will be explained hereafter, through passage 39 (FIGS. 2 and 3) over the spray hose 30 finally emitting as a cleansing spray through discharge nozzle 31. It is important to the operation of the present invention that the discharge nozzle 31 is in its operating, or spraying position, before water is passed to it, and that the nozzle will remain in that position until the water is shut off at the spring-loaded control valve 22. The discharge nozzle 31 will return to its operative position beneath the internal rim of the toilet bowl when the control lever 25 is released. While in the preferred embodiment, the flexibility of control lever 25 is considered sufficient to cause the retraction of the mechanism, springs may be incorporated to assist in the full extension of the lever to its original position. As will also be appreciated, return of the control lever to its inoperative position may also be assisted by the anti-clockwise motion of the actuating cam 27.

Looking more particularly to FIG. 3, a further attachment to the device according to the invention is shown in the form of a dual container generally indicated at 39. In its preferred form, this container is separated into two compartments 40 and 41, compartment 40 containing liquid soap, and compartment 41 containing a deoderant solution, or, if required, a liquid medicine. Container 39 is releasably attached to the bidet mechanism by hooks or hangers 43. In use, when the control lever 25 is being held in the spraying position and emitting water, then either or both buttons 44 and 45 (FIGS. 2 and 3) may be depressed. Such an action will open spring loaded sliding valves 46, thereafter allowing the extraction of either soap from compartment 40, or deoderant solution from compartment 41, via venturi tubes into the main flow of water travelling towards the discharge nozzle. The liquid is extracted from the selected compartment by the suction created by the water flow past tubes 37 on route to the discharge nozzles. The liquid from either or both compartments is then drawn through a screen mesh or filter 47; a removable plastic tube 48; screw on cap 49; plastic tubing 30; to the spring-loaded sliding valves 46, from which it passes via venturi tubes 37 into passage 36 where it is mixed by turbulent action, into the water travelling to the discharge nozzle 31. When buttons 44 and/or 45 are released, sliding valves 46 return to the closed position, thus stopping the discharge from venturi tubes 37. It must be noted that the spraying pressure, or other action will not be affected by the opening or closing of valves 46. To refill compartments 40, 41, screw caps 49 are removed and container 39 detached from the bidet mechanism. Plastic tubes 48 with attached filters 47 can be removed from the compartment and the compartments refilled as desired. In an alternative arrangement, the liquid could be introduced into the water spray by a hand or finger actuated pump thus simplifying the bidet mechanism by removing the necessity for valves 46 and venturi tubes 37.

The temperature, and maximum water pressure of the spray discharged from nozzle 31 is determined from valves 12 which are attached to the hot and cold water pipes as in FIG. 1, or by the faucet settings when the slip and clamp-on device 18 on FIG. 1*a* is installed on the water spout of a basin or bathtub. Initially prior to operating the bidet and making the connection to the main water supply, the faucet to the basin or bathtub should be opened until the hot water reaches its maximum temperature and the cold water reaches its minimum temperature (especially during the winter months), so that the water in pipes 11 can be mixed to a safe and comfortable temperature.

In order to adjust a comfortable water temperature and maximum water pressure, valves 12 should be open to maximum flow and then the control lever 25 fully depressed. The palm of the hand may then be held above the discharge nozzle 31, or, prior to the coupling of the bidet mechanism with adaptor 10 below male connection 15 or 20 (FIGS. 1 and 1*a*), and the valves 12 adjusted until a comfortable temperature and maximum pressure are obtained. The same procedure could be followed with the connection as shown in FIG. 1*a*, by for example, making adjustments to faucet before attachment of the slip and clamp-on connection 17.

Of particular note is that the valves 12 control the temperature and "maximum" pressure of the water to the bidet mechanism, while the control valve 22 controls the "variable" pressure of the water to the discharge nozzle.

Figure 5:
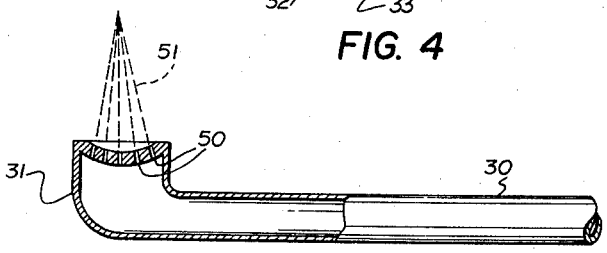
FIG. 5 (on sheet 2) is a part section of a preferred discharge tube and nozzle, the nozzle being formed to provide a focused spray.

With reference to FIG. 5, it will be noted that ports 50 of the discharge nozzle 31 are designed to focus the spray 51 to a point which in practice would be between 4 and 5 inches above the discharge nozzle. By focusing the water spray in this manner, the area wetted during the cleansing action of the spray will be kept to a minimum, while directing the water to that area requiring cleansing.

Looking now to FIG. 6, the bidet mechanism according to the invention is shown in its operating position attached to the rim of a toilet bowl 24. Actuation of the control lever 25 is directionally presented by arrows C and D and the various components enumerated.

In order to provide a complete bidet service, especially for the handicapped, infirmant or elderly, a fan unit and air venting device may be incorporated in order to provide a drying action to the area wetted by the spray nozzle.

Figure 7:
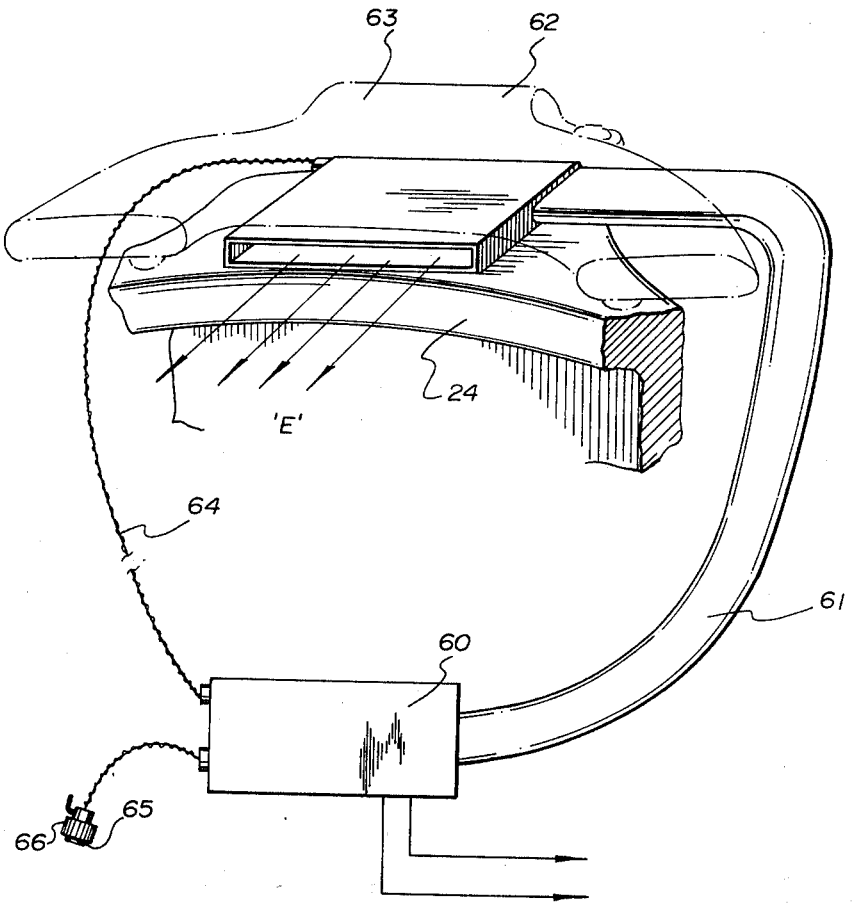
FIG. 7 shows in perspective the arrangement of a hot air drying unit which may be utilized in conjunction with the apparatus according to the invention.

As can be seen from FIG. 7, this drying device, which again is completely portable, may consist of a fan unit 60, which can discharge air at ambient or heated temperatures through a soft plastic hose 61 to an air vent, or nozzle 62 which is designed to fit between the toilet seat 63 (shown in phantom) and the toilet bowl 24, at the rear of the bowl, and discharge air towards the front of the bowl, in the direction of arrows "E". The fan unit 60 may be suspended behind the toilet bowl by means of cord 64 which connects the fan to the air vent of the opposite side of the hose connection. The fan may be operated by a control button 65 which preferably would be clipped onto the rear portion of the bidet control lever mechanism, the fan only operating during the time the button is depressed. Fan unit 60 and/or nozzle 62 may be mounted conveniently on the studs which connect the toilet seat to the toilet bowl. It is believed that a preset, fixed air temperature would be sufficient for general purposes, however a variable control 66, shown integrated with button 65, could be included, operable to either increase or decrease the fan speed or increase or decrease current flow to the heating element.

When the invention is being utilized in a commercial installation, it may include a cover to provide means whereby tampering may be prevented. The cover, (not illustrated), will completely enclose the bidet mechanism and depending container with holes provided to allow for entry of pipes or hoses, control lever, and access to the buttons 44 and 45. A simple locking device would be provided to lock the cover in place on the rim of the toilet bowl and to facilitate quick removal of the cover to enable servicing of the unit, and cleansing of the toilet bowl rim. Further modifications and alternative embodiments of the invention will be apparent to those skilled in the art in view of the description. Accordingly the description is to be construed as illustrative only and is for the purpose of leading those skilled in the art, the manner of carrying out the invention. It is understood that the form of the invention herewith shown and described is to be taken as the presently preferred embodiment. Various changes may be made in the shape, size and general arrangement of components. For example, equivalent elements or material may be substituted for those illustrated and described herein, parts may be reversed and certain features of the invention may be utilized independently of the use of other features, all as will be apparent to one skilled in the art after having the benefit of this description of the invention.

What I claim is:

1. A portable bidet comprising:

a. adaptor means facilitating the interconnection of said bidet with a source of water under pressure;

b. a water discharge tube and nozzle mounted to permit movement from an inoperative position substantially beneath the internal rim of a toilet bowl to a predetermined operative position wherein said nozzle lies substantially centrally of said bowl;

c. valve means for variably controlling the flow of water to said discharge tube and nozzle, and;

d. manually operable lever means pivotally mounted adjacent said bowl including first actuator means for moving said discharge tube and nozzle from an inoperative position to said operative position and second actuator means for said valve means whereby initial movement of said lever means affects movement of said discharge tube and nozzle to said operative position, and continued movement of said lever means in the same direction affects gradual opening of said valve means without causing further displacement of said discharge tube and nozzle from said operating position.

2. A bidet according to claim 1 wherein said adaptor means provides for the reception of hot and cold water streams, and the mixing thereof to a predetermined operating temperature.

3. The bidet according to claim 2 wherein at least a portion of said discharge tube at an end remote from said nozzle is flexible.

4. The bidet according to claim 1 wherein said first actuator means comprises a first projecting portion of said lever and an actuator member mounted on shaft means, the end of said shaft means remote from said actuator member carrying an operating member adapted to engage with said discharge tube and cause movement thereof.

5. The bidet according to claim 4 wherein said actuator member is formed with a cam-like profile, which permits movement of said discharge tube and nozzle only to the desired operating position.

6. The bidet according to claim 4 wherein said first projecting portion of said lever carries a rack adjacent the distal end thereof and said actuator member is in the form of a pinion engageable with said rack, said rack being dimensioned to permit movement of said discharge tube and nozzle only to the desired operating position.

7. The bidet according to claim 5 wherein said second actuator means includes a second projecting portion on said lever means spaced from said first projecting portion longitudinally of said lever means towards the distal end thereof and whereby actuation of said valve means is a result of contact between said valve means and said second projecting portion.

8. The bidet according to claim 1 including means for introducing fluid other than water into the water being discharged through said nozzle.

9. The bidet according to claim 8 wherein said fluid is a soap solution.

10. The bidet according to claim 8 wherein said fluid is a deoderant solution.

11. The bidet according to claim 8 wherein said fluid is a medical preparation in solution.

12. The bidet according to claim 8 wherein said means comprises a container releasably attached to said bidet, said container having at least one compartment therein, for the retention of said fluid.

13. The bidet according to claim 12 wherein said fluid is extracted by suction means from said at least one compartment.

14. The bidet according to claim 13 wherein said suction means includes at least one venturi tube positioned in operable association with the water passing to said nozzle and with a siphoning system, said suction means being operable by manually actuated valve means.

15. The bidet according to claim 14 wherein said container includes two compartments each of which contains a different fluid, each compartment being provided with a separate siphoning system, individually actuated by an independent, manually operated valve means, and responsive to variation in water pressure at the region of said at least one venturi tube.

16. The bidet according to claim 1 wherein said nozzle means is formed with a plurality of outlet ports, each port being angularly oriented such that the individual water jets are focused to impinge at a predetermined focal point above said nozzle.

17. The bidet according to claim 16 including a drying facility operable independently of said bidet.

18. The bidet according to claim 17 wherein said drying facility includes a hot air blower assembly comprising an air delivery nozzle releasably secured at the rear of said bowl between said bowl and a toilet seat; an air heater and fan unit for supplying air at a predetermined temperature via conduit means to said air delivery nozzle.

19. The bidet according to claim 18 including means for variably controlling the temperature of air being delivered to said air delivery nozzle.

* * * * *